US005576808A

United States Patent [19]

Ikegawa et al.

[11] Patent Number: 5,576,808

[45] Date of Patent: Nov. 19, 1996

[54] IMAGE FORMING APPARATUS HAVING CONTACT CHARGER

[75] Inventors: Akihito Ikegawa, Sakai; Masashi Yamamoto, Settu, both of Japan

[73] Assignee: Minolta Co., Ltd., Osaka, Japan

[21] Appl. No.: 554,452

[22] Filed: Nov. 7, 1995

[30] Foreign Application Priority Data

Nov. 8, 1994 [JP] Japan ..... 6-273557

[51] Int. Cl.[6] ..... G03G 15/02

[52] U.S. Cl. ..... 355/219; 347/248; 355/211

[58] Field of Search ..... 355/219, 211, 355/212; 347/133, 140, 261, 256, 260, 243, 259, 248, 234

[56] References Cited

U.S. PATENT DOCUMENTS 5,148,219 9/1992 Kohyama ..... 355/219
5,221,946 6/1993 Kohyama ..... 355/270

FOREIGN PATENT DOCUMENTS 56-104346 8/1981 Japan .

*Primary Examiner*—Matthew S. Smith
*Attorney, Agent, or Firm*—Brinks Hofer Gilson & Lione

[57] ABSTRACT

An image forming apparatus includes a charging member in contact with a photosensitive member for applying a charging voltage at least containing an a.c. component, a laser beam irradiator having a polygon mirror to form an electrostatic latent image and a developing unit for developing the latent image into a visible image and collecting residual developer remaining on the surface of the photosensitive member after the visual image is transferred to a transfer material. The number of revolutions Fp(rps) of the irradiator polygon mirror, the frequency Fb(Hz) of the a.c. component to be applied to the contact charging unit and the system velocity Vp(cm/sec) have a correlation so determined as to meet the requirement of:

$$|Fp-2\times Fb|<Vp \text{ or } |Fp-2\times Fb|>Fp/2.$$

3 Claims, 3 Drawing Sheets

Fig. 2(A)
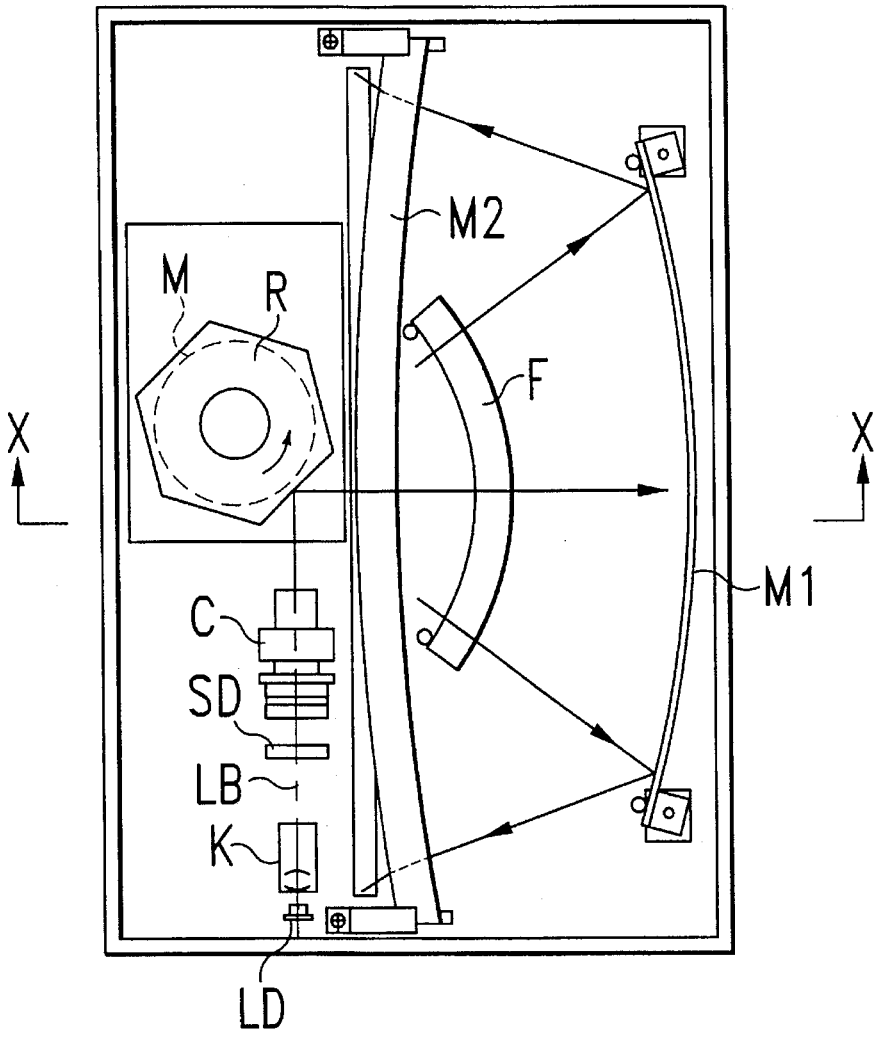
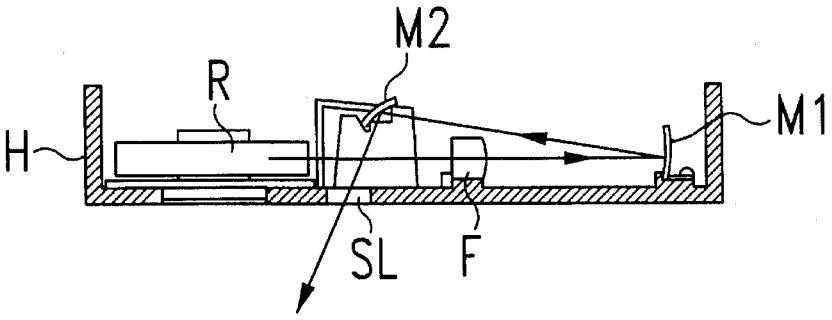
Fig. 2(B)

IMAGE FORMING APPARATUS HAVING CONTACT CHARGER

BACKGROUND OF THE INVENTION

1. Field of the Invention

The present invention relates to electrophotographic copying machines, printers and like image forming apparatus, and more particularly to apparatus wherein a laser beam is used for forming images on the surface of a photosensitive member charged by a contact charger.

2. Description of the Related Art

Electrophotographic copying machines, printers or like image forming apparatus produce copy images generally by charging a photosensitive member by a charging unit, exposing the charged area to an optical image to form an electrostatic latent image, developing the latent image into a visible image, transferring the visible image to a sheet and fixing the image thereto. After the transfer, the developer remaining on the surface of the photosensitive member is removed by a cleaner.

To meet the demand that the apparatus be made more compact and less costly, various apparatus wherein the cleaner is dispensed with have also been proposed recently. For example, U.S. Pat. No. 5,148,219 discloses a so-called cleanerless image forming apparatus including a developing unit which is serviceable also as a cleaner. Such developing units have a developing sleeve or like developer support which is usually brought into contact with the surface of the photosensitive member to collect the residual developer utilizing the magnitude of field intensity of the developing region. Typical of these units are those wherein the developer support in contact with the photosensitive member develops the exposed area to form a visible image and also collects the developer remaining on the unexposed area after the transfer of the visible image to a sheet.

The voltage to be applied to the charging unit for charging the photosensitive member prior to an exposure is usually a d.c. voltage, while it is also practice to apply a voltage containing an a.c. component from the viewpoint of stabilizing the charge potential of the photosensitive member and dissipating a memory due to the residual developer (see Japanese Laid-Open Patent Application No. 56-104346).

Various image exposure units are available for different types of image forming apparatus. For example, laser beam printers and digital copying machines include a laser beam irradiator for exposing the photosensitive member to an image corresponding to an original image.

However, image noise in the form of lateral streaks which are discernible as irregularities in density appears when dot patterns or like half-tone images are formed by image forming apparatus of the type which is adapted to charge the photosensitive member by applying a charging voltage containing an a.c. component to a charging member in contact with the photosensitive member, scan the charged photosensitive member with a laser beam to form an electrostatic latent image, and develop the latent image and collect residual toner by a developing unit after transfer.

SUMMARY OF THE INVENTION

The main object of the present invention is to provide an image forming apparatus which is adapted to inhibit occurrence of image noise.

Another object of the invention is to provide an image forming apparatus which comprises an exposure unit including a polygon mirror for reflecting a scanning laser beam, and a contact charging unit and in which a voltage containing an a.c. component is applied to the charging unit, the apparatus being adapted to inhibit occurrence of image noise in the form of white streaks while ensuring a stabilized charge.

Still another object of the invention is to provide an image forming apparatus wherein development is effected simultaneously with cleaning and which includes a contact charging unit having a charging member in contact with a photosensitive member, a charging power source for applying a charging voltage at least containing an a.c. component to the contact charging unit, a laser beam irradiator for exposing to an image a charged area of the photosensitive member as moved past the contact charging unit, and a contact developing unit having a developer support in contact with the photosensitive member for developing the exposed area to form a visible image and collecting residual developer remaining on an unexposed area after the transfer of the visible image to a transfer material, the apparatus being adapted to inhibit occurrence of image noise in the form of unnegligible lateral streaks which are discernible as irregularities in density even when forming so-called half-tone images such as dot patterns.

To fulfill the above objects, the present invention provides an image forming apparatus comprising:

- a photosensitive member,
- a contact charging unit having a charging member in contact with the photosensitive member,
- a charging power source for applying a charging voltage at least containing an a.c. component to the contact charging unit,
- a laser beam irradiator having a polygon mirror for use in exposing the photosensitive member to an image over an area thereof charged by the charging unit to form an electrostatic latent image, and
- a developing unit for developing the latent image into a visible image and collecting residual developer remaining on the surface of the photosensitive member after the visual image is transferred to a transfer material,
- the number of revolutions Fp (rps) of the irradiator polygon mirror, the frequency Fb (Hz) of the a.c. component to be applied to the contact charging unit and the system velocity Vp (cm/sec) having a correlation so determined as to meet the requirement of:

$$|Fp-2\times Fb|<Vp \text{ or } |Fp-2\times Fb|>Fp/2$$

These and other objects, advantages and features of the invention will become apparent from the following description thereof taken in conjection with the accompanying drawings with illustrative specific embodiments of the invention.

BRIEF DESCRIPTION OF THE DRAWINGS

FIG. 2 shows an example of laser beam irradiator, FIG. 2 (A) being a plan view showing the housing of the irradiator with its ceiling portion removed, FIG. 2 (B) being a view in section taken along the line X—X in FIG. 2 (A)

DETAILED DESCRIPTION OF THE PREFERRED EMBODIMENTS

The preferred embodiments of the present invention are described hereinafter with reference to the accompanying drawings.

In the course of research for solving the foregoing problem, we have found that the image noise in the form of lateral streaks occurs for the following reason.

(1) The a.c. component applied to the charging unit alters the force of electrostatic attraction of the charging member acting on the photosensitive member, consequently varying the speed of movement of the photosensitive member surface and giving rise to irregularities in the speed of movement of the surface.

(2) The polygon mirror included in the laser beam irradiator is not always accurately installed but usually has its surface tilted slightly. Stated more specifically, the central axis of rotation of the mirror is likely to incline from the normal position, therefore tilting the laser beam reflecting mirror surface from the normal position. The tilt then deflects the exposure position on the photosensitive member with respect to the subscanning direction or produces irregularities in pitch.

(3) The irregularities in the surface speed of the photosensitive member and the tilt of the polygon mirror, if occurring, combine to produce image noise in the form of lateral streaks which are discernible as irregularities in density when dot patterns or like half-tone images are formed.

We have conducted further research and found that the occurrence of the discernible and unnegligible streaklike image noise can be inhibited by suitably displacing the frequency of the a.c. component to be applied to the charging unit relative to the rotation cycle of the polygon mirror.

Figure 1:
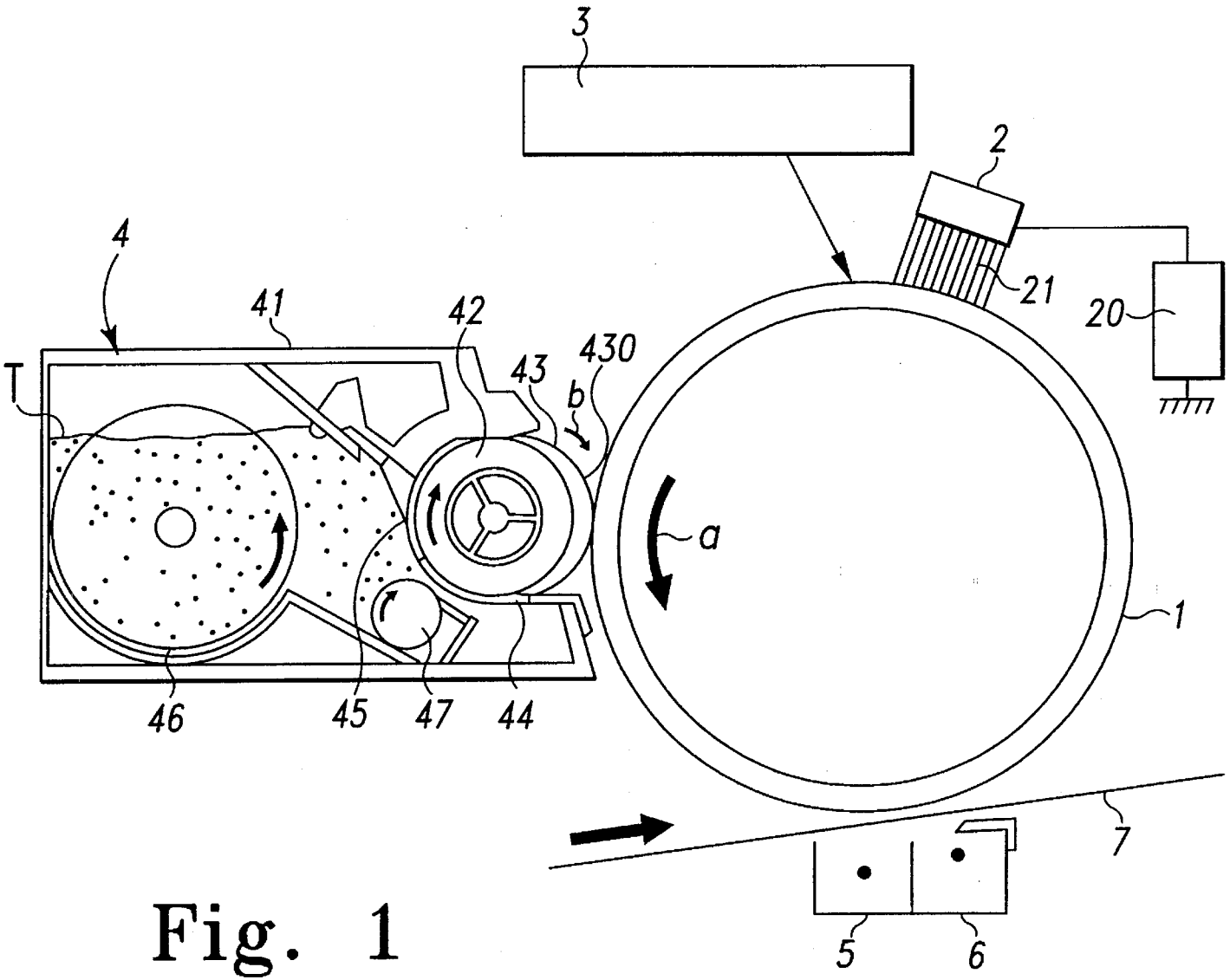
FIG. 1 is a diagram schematically showing the construction of an embodiment of the invention, i.e., a printer.

The embodiments of the invention will be described below with reference to the drawings. FIG. 1 schematically shows the construction of a printer as one of the embodiments of the invention.

The printer has a photosensitive drum 1 in its center. The drum 1 is drivingly rotated by an unillustrated drive device in the direction of arrow a shown (counterclockwise direction). Successively arranged around the drum 1 are a brush charging unit 2, developing unit 4, transfer charger 5 and separating charger 6. A laser beam irradiator 3 is disposed above the drum 1.

The charging unit 2 comprises an electrically conductive charging brush 21 attached to an electrically conductive base plate and in contact with the surface of the photosensitive drum 1. A power source 20 applies a charging voltage comprising a d.c. voltage and an a.c. voltage superposed thereon to the unit 2, whereby the surface of the drum 1 can be charged uniformly to −800 (V). More specifically stated, the power source 20 is designed to apply to the brush charging unit 2 a voltage comprising a d.c. voltage of −800 (V) and an a.c. voltage superposed thereon and having a peak-to-peak voltage of 800 (V) to 1.2 (kV) and a frequency of 20 (Hz) to 500 (Hz). The surface of the drum 1 can be charged to −800 (V) with good stability by the application of the voltage.

The laser beam irradiator 3 utilizes a semiconductor laser which is generally known. In principle, the semiconductor laser emits a laser beam, which is passed through a collimator lens and cylindrical lens, reflected at a rotating polygon mirror, further passed through an fθ lens and collected on the surface of the drum 1 charged to −800 (V) to reduce the charge on an image area to −50 (V).

FIG. 2 shows the laser beam irradiator 3. FIG. 2 (A) is a plan view showing the housing H of the irradiator with its ceiling portion removed, and FIG. 2 (B) is a view in section taken along the line X—X in FIG. 2 (A). With this device, the laser beam LB emitted by the semiconductor laser (laser source) LD is converted to a convergent beam by passing through a collimator lens K, adjusted in shape by passing further through a slit portion SD and a cylindrical lens C and projected on a polygon mirror R. The polygon mirror R, which has six reflecting faces, is drivingly rotated by a scanner motor M so as to scan the photosensitive drum with the laser beam as reflected at each reflecting face upon projection thereon. The beam reflected from the polygon mirror R passes through an fθ lens F, whereby the reflected beam can be made to collect on the photosensitive drum. The beam passing through the lens F is reflected at spherical mirrors M1 and M2 and irradiates the surface of the photosensitive drum 1 through a slit SL in the housing H accommodating the above components to form an electrostatic latent image.

The developer unit 4, which uses a single-component developer, comprises a drive roller 42 supported by a casing 41 and drivingly rotatable in the direction of arrow b shown (clockwise direction), a flexible developing sleeve 43 fitted around the roller and having an inside diameter slightly larger than the outside diameter of the roller, and pressure belt members 44 pressing opposite ends of the sleeve against the drive roller 42 from inside the casing 41 to form a slack portion 430 at opposite side and hold the slack portion in contact with the photosensitive drum 1. Inside the casing 41, a regulating blade 45 of metal is pressed into contact with the developing sleeve 43.

The single-component developer, i.e., toner T, accommodated in the casing 41 is supplied to a toner transport roller 47 while being agitated by an agitator member 46 which is drivingly rotated counterclockwise in FIG. 1. The roller 47 moves the toner T toward the developing sleeve 43 while being drivingly rotated clockwise in the drawing. With the rotation of the drive roller 42, the developing sleeve 43 is driven in the same direction as the drive roller by a frictional force, while the regulating blade 45 causes a specified amount of the toner T to adhere to the developing sleeve 43 while triboelectrifying the toner T. The developing sleeve further feeds the toner T to the portion of the drum 1 in contact therewith by virtue of the rotation of the sleeve.

A developing bias voltage of −250 (V) is applied to the developing sleeve 43 from an unillustrated power source. The toner T can be adhered to the electrostatic latent image on the drum 1 by the bias voltage.

In order to prevent noticeable streaklike image noise from occurring in the present printer, the number of revolutions Fp (rps) of the polygon mirror R, the frequency Fb (Hz) of the a.c. voltage to be applied to the charging unit 2 and the system velocity (peripheral speed of the photosensitive drum) Vp (cm/sec) are so determined that the correlation therebetween meets the requirement of:

$$|Fp-2\times Fb|<Vp \text{ or } |Fp-2\times Fb|>Fp/2$$

Incidentally, the unit (rps) of the number of revolutions Fp of the polygon mirror represents the number of revolutions of the mirror per second. The system velocity Vp is usually the same as the speed of movement of the photosensitive drum surface.

It is thought useful that the number of revolutions Fp (rps) of the polygon mirror, the frequency Fb (Hz) of the a.c. component and the system velocity Vp (cm/sec) be usually approximately Fp=50–500 (rps), Fb=20–1000 (Hz) and Vp=2–30 (cm/sec) although these values are not limitative.

|Fp–2×Fb| in the above conditional expression represents the following.

Figure 3:
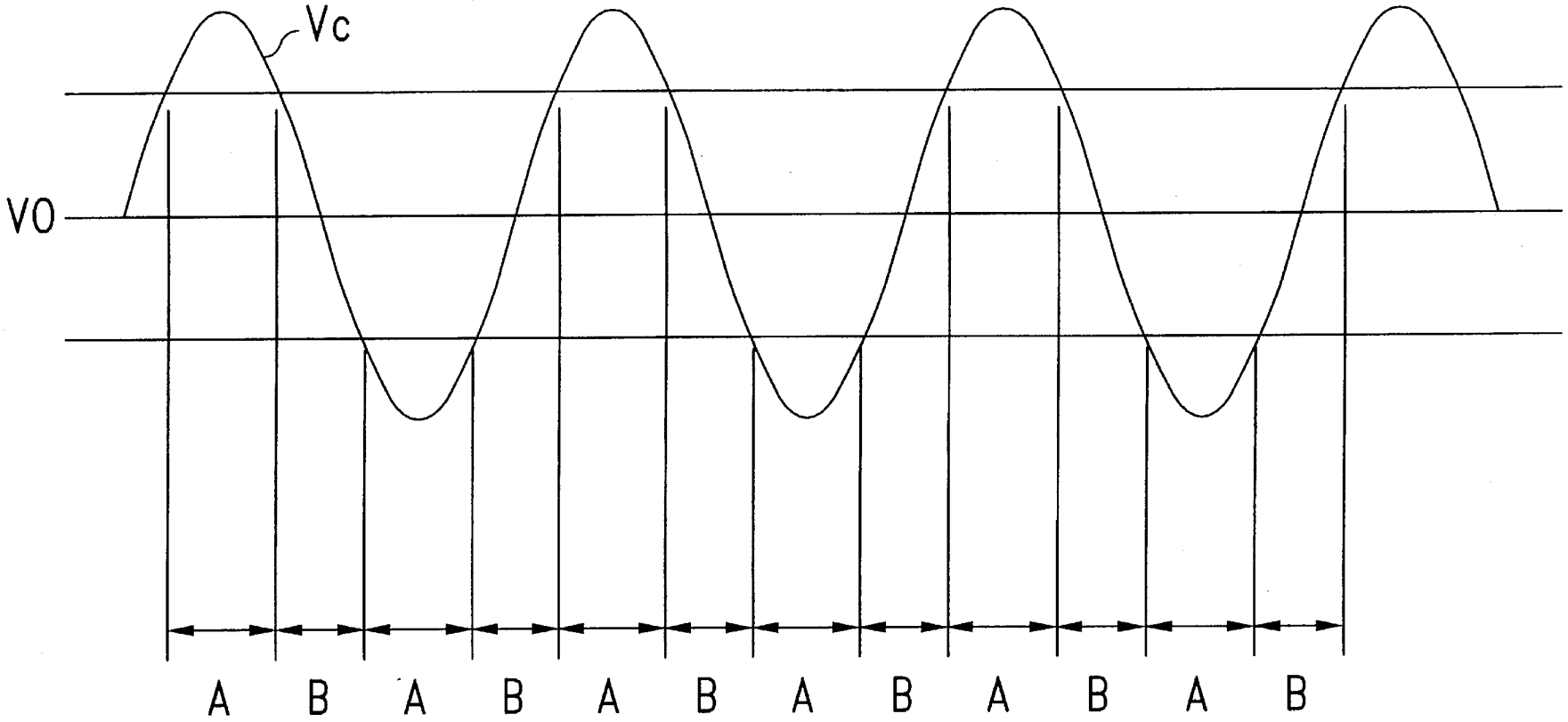
FIG. 3 is a diagram for illustrating the cause for irregularities in the speed of rotation of a photosensitive drum.

For example, when the sinusoidal voltage Vc shown in FIG. 3 is applied to the charging member, the force of electrostatic attraction acting between the photosensitive drum and the charging member varies depending on the difference |Vc–Vo| between the potential Vo on the drum surface and the potential Vc given to the charging member. With reference to FIG. 3, attraction repeatedly takes place in A sections of crests and troughs, and release in B sections of transitions from the crest to the trough and from the trough to the crest. Accordingly, the frictional force acting circumferentially of the drum repeatedly varies in an undulating fashion, altering the torque of the drum and giving rise to irregularities in the rotation at a rate corresponding to twice the frequency of the a.c. component applied. Thus, variations occur in the dot-to-dot spacing in the subscanning direction with the rotation cycle of the polygon mirror owing to the tilt of the mirror, while irregularities in the speed of movement of the drum surface due to the variations in the force of electrostatic attraction between the charging member and the drum occur at a rate corresponding to twice the frequency of the a.c. component applied.

Regarding the number of revolutions Fp (rps) of the polygon mirror as a frequency, |Fp–2×Fb| indicates how many times the "beat (crest of wave)" resulting from the combination of these two waves appears per unit time. For example when the number of times is the system velocity Vp (cm/sec), therefore, greatly lapping portions of the waves appear at an interval of 1 cm, and these portions are discernible in the form of streaks. Our research has reveals that if appearing at an interval greater than 1 cm, such streaklike noise will not show up in images of usual pattern, is not conceivable as noise and can be neglected.

Thus, the foregoing conditional expression |Fp–2×Fb|<Vp is adopted.

The conditional expression |Fp–2×Fb|>Fp/2 indicates that the number of times the "beat" appears per unit time, as represented by |Fp–2×Fb|, is greater than ½ of the number of revolutions of the polygon mirror. Usually the polygon mirror scans in the subscanning direction only by a distance corresponding to 6 to 8 dots per turn of rotation if the amount great. Since one dot corresponds to 50 to 100 μm, the distance is about 300 to about 800 μm in total.

The expression |Fp–2×Fb|>Fp/2 indicates that image noise in the form of lateral streaks due to "beat" occurs at an interval of less than 2 times the polygon mirror cycle. Even if streaklike noise occurs in such a state, the noise is not readily discernible and can be neglected.

Accordingly, the conditional expression |Fp–2×Fb|>Fp/2 is adopted.

The photosensitive drum 1, the toner T used and the developing sleeve 43 will be described in detail next.

Photosensitive drum 1

The drum comprises an aluminum substrate (drum), a charge generating layer (CGL) comprising phthalocyanine and a binder resin, having a thickness of about 0.1 μm and formed on the substrate, and a charge transport layer (CTL) comprising a hydrazone derivative and a binder resin, having a thickness of about 18 μm and formed over the CGL. Each of the layers was formed by repeating dipping for coating and the subsequent drying.

Toner T

A negatively chargeable single-component nonmagnetic toner having the following composition and prepared by the method described below.

| | |
|---|---|
| Polyester resin of bisphenol A type | 100 parts by weight |
| Carbon black (MA#8, product of Mitsubishi Chemical Industries, Ltd.) | 5 parts by weight |
| Charge control agent (BONTRON S-34, product of Orient Kagaku Kogyo Co., Ltd.) | 3 parts by weight |
| Wax (BISCOL TS-200, product of Sanyo Kasei Kogyo Co., Ltd.) | 2.5 parts by weight |

The above mixture was kneaded, pulverized and classified in the usual manner to obtain a particulate toner having a mean particle size of 10 μm and including 80 wt. % of particles ranging from 7 to 13 μm in size. Furthermore, 0.75 part by weight of a finely divided silica (TS 500, product of CABOSIL Co., Ltd.) was added to the particulate toner for surface treatment.

Developing sleeve 43

A stainless steel bar (25 mm in diameter) was immersed in a nickel electrolyte, and a film of about 35 μm in thickness was formed over the bar by electrocasting. The width of the nip between the sleeve 1 and the drum 1 is about 1 to about 1.5 mm during development.

The regulating blade 45 is adapted to deposit the toner T on the developing sleeve 43 in an amount of 0.6 mg/cm$^2$ in the form of a layer having a thickness of about 0.03 mm with a charge of –20 μc/g.

With the printer described above, the surface of the photosensitive drum 1 which is drivingly rotated is uniformly charged by the brush charging unit 2 to a surface potential of –800 (V), and the charged area is exposed to an image by a laser beam irradiator 3 to form an electrostatic latent image. The surface potential of the exposed area drops to about –50 (V). The latent image thus formed is developed into a toner image by the developing unit 4 at a developing bias voltage of –250 (V). For the development, the toner T on the developing sleeve 43 adheres to the latent image with a potential difference ΔV of 200 (V).

The toner image formed in this way is transferred by the transfer charger 5 to paper 7 sent forward from a paper feeder (not shown), and the paper 7 bearing the transferred image is separated from the drum 1 by the separating charger 6 and transported to an unillustrated fixing unit, by which the tomer image is fixed to the paper. The print is then discharged from the printer.

However, the toner on the drum 1 is not wholly transferred onto the paper 7 by the transfer charger 5 but usually 10 to 20% of the toner remains on the drum 1 as residual toner. The residual toner is charged by the charging unit 2, is exposed to the step of exposure by the laser beam irradiator 3 when required and reaches the developing unit 4 again, whereupon the residual toner on the nonimage area is collected by the developing sleeve 43.

In the case where the drum 1 is charged and exposed with the residual toner remaining thereon, the problem that a portion of the residual toner remains uncharged for unexposed appears to arise, whereas insofar as the iamge eventually obtained is concerned, such a problem is avoidable if the transfer charger 5 always achieves a transfer efficiency of at least 60%. Presumably this is attributable to the following reason. Even if a small amount of toner remains on the drum 1, the charging unit 2 disturbs the residual toner with its contact charging brush 21, uniformly charging the surface of the drum 1, while as to the exposure, the laser beam will make its way through the residual toner to the lower portion thereof.

The developing unit 4 collects and removes the residual toner through the mechanism to be described below.

As previously described, the drum 1 has an approximately uniform surface potential of about −800 (V) even at the residual toner bearing portion. On the other hand, the developing bias voltage of −250 (V) is applied to the developing sleeve 43.

Accordingly, the residual toner T on the nonimage area of the drum 1 is subjected to a force acting to move the toner toward the developing sleeve 43 with a potential difference of about 550 (V), and at the same time, the developing sleeve 43 assists in this movement with its effect to scrape off the residual toner, whereby the residual toner on the nonimage area is collected and removed toward the sleeve 43.

The number of revolutions Fp (rps) of the polygon mirror of the laser beam irradiator 3, the frequency Fb (Hz) of the a.c. voltage to be applied to the contact charging unit 2 and the system velocity Vp (cm/sec) have a correlation so determined as to meet the requirement of:

$$|Fp-2\times Fb|<Vp \text{ or } |Fp-2\times Fb|>Fp/2$$

Consequently, the occurrence of image noise in the form of unnegligible lateral streaks which are discernible as variations in density are inhibited even when so-called half-tone images such as dot patterns are formed, notwithstanding the "beats" resulting from the tilt of the polygon mirror and irregularities in the speed of movement of the drum surface due to variations in the force of electrostatic attraction of the brush 21 of the charging unit 2 acting on the drum 1. In other words, such noise, if occurring, can be inconspicuous and negligible.

Next, image forming experiments were conducted with the peak-to-peak voltage value set at 1.0 kV and with the foregoing requirement fulfilled by the correlation between the number of revolutions Fp (rps) of the polygon mirror R, the frequency Fb (Hz) of the a.c. voltage applied to the contact charging unit 2 and the system velocity Vp (cm/sec). The table given below shows the results obtained by checking the images formed for noise. The table also shows the results obtained by checking the noise of images formed by comparative experiments which were conducted with the requirement not fulfilled by Fp, Fb and Vp.

The image noise level was checked according to the following criteria.

Twenty-five percent dot images 30 mm square and having a density of 300 dpi were formed, and then checked for noise level according to the two criteria of "○" indicating an acceptable level, and "X" indicating an unacceptable level.

| | Fp (rps) | Fb (Hz) | Vp (cm/s) | \|Fp − 2Fb\| | Noise evaluation |
|---|---|---|---|---|---|
| Exp. Example 1 | 112 | 55 | 3.8 | 2 *1 | ○ |
| Exp. Example 2 | 112 | 25 | 3.8 | 62 *2 | ○ |
| Exp. Example 3 | 112 | 100 | 3.8 | 88 *2 | ○ |
| Exp. Example 4 | 125 | 60 | 6.35 | 5 *1 | ○ |
| Exp. Example 5 | 125 | 100 | 6.35 | 75 *2 | ○ |
| Exp. Example 6 | 125 | 30 | 6.35 | 65 *2 | ○ |

-continued

| | Fp (rps) | Fb (Hz) | Vp (cm/s) | \|Fp − 2Fb\| | Noise evaluation |
|---|---|---|---|---|---|
| Exp. Example 7 | 250 | 123 | 6.35 | 4 *1 | ○ |
| Exp. Example 8 | 250 | 200 | 6.35 | 150 *2 | ○ |
| Comp. Exp. Ex. 1 | 112 | 50 | 3.8 | 12 | X |
| Comp. Exp. Ex. 2 | 112 | 70 | 3.8 | 28 | X |
| Comp. Exp. Ex. 3 | 125 | 50 | 6.35 | 25 | X |
| Comp. Exp. Ex. 4 | 125 | 80 | 6.35 | 35 | X |
| Comp. Exp. Ex. 5 | 250 | 100 | 6.35 | 50 | X |
| Comp. Exp. Ex. 6 | 250 | 150 | 6.35 | 50 | X |

In the above table, *1 indicates that the requirement of $|Fp-2\times Fb|<Vp$ is fulfilled, and *2 indicates that the requirement of $|Fp-2\times Fb|>Fp/2$ is met.

The above results reveal that unacceptable noise appears at a pitch spacing of 10 mm to several millimeters, and that noise can be rendered inconspicuous when the number of revolutions Fp (rsp) of the polygon mirror, the frequency Fb (Hz) of the a.c. component to be applied to the contact charging unit 2 and the system velocity Vp (cm/sec) are made to have the correlation of:

$$|Fp-2\times Fb|<Vp \text{ or } |Fp-2\times Fb|>Fp/2$$

As described above, the present invention provides an image forming apparatus which is adapted to inhibit occurrence of image noise in the form of unnegligible lateral streaks which are discernible as irregularities in density even when forming so-called half-tone images such as dot patterns.

Further stated, the image forming apparatus embodying the invention inhibits occurrence of image noise in the form of unnegligible lateral streaks which are discernible as irregularities in density even when so-called half-tone images such as dot patterns are formed, in spite of the "beats" resulting from the tilt of the polygon mirror and irregularities in the speed of movement of the photosensitive member due to variations in the force of electrostatic attraction of the charging member of the contact charging unit acting on the photosensitive member. In other words, such noise, if occurring, can be inhibited to an inconspicuous and negligible extent.

Although the charging brush of the contact charging unit described is of the fixed type according to the foregoing embodiment, the charging member of the contact charging unit is not limited thereto but may be a rotary charging brush comprising electrically conductive bristles provided radially around a conductive shaft. Other members such as charging roller, charging blade and charging belt are also useful.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a photosensitive member;

a contact charging unit having a charging member in contact with the photosensitive member;

a charging power source for applying a charging voltage at least containing an a.c. component to the contact charging unit;

a laser beam irradiator having a polygon mirror for use in exposing the photosensitive member to an image over an area thereof charged by the charging unit to form an electrostatic latent image; and a developing unit for developing the latent image into a visible image and collecting residual developer remaining on the surface of the photosensitive member after the visual image is transferred to a transfer material;

the number of revolutions Fp(rps) of the irradiator polygon mirror, the frequency Fb(Hz) of the a.c. component to be applied to the contact charging unit and the system velocity Vp(cm/sec) having a correlation so determined as to meet the requirement of:

$$|Fp-2\times Fb|<Vp \text{ or } |Fp-2\times Fb|>Fp/2.$$

2. An image forming apparatus as claimed in claim 1, wherein said charging power source applies the a.c. component having a peak-to-peak voltage of 800(V) to 1.2(kV) and a frequency of 20(Hz) to 500(Hz).

3. An image forming apparatus as claimed in claim 1, wherein the number of revolutions Fp(rps) of the polygon mirror, the frequency Fb(Hz) of the a.c. component and the system velocity Vp(cm/sec) is approximately Fp=50–500(rps), Fb=20–1000(Hz) and Vp=2–30(cm/sec).

* * * * *